US011784020B2

(12) United States Patent
Kawaguchi et al.

(10) Patent No.: US 11,784,020 B2
(45) Date of Patent: Oct. 10, 2023

(54) ELECTROMAGNETIC RELAY

(71) Applicant: OMRON Corporation, Kyoto (JP)

(72) Inventors: Naoki Kawaguchi, Kyoto (JP); Takeshi Nishida, Kyoto (JP); Kazuki Furukawa, Kyoto (JP); Takashi Tsukada, Kyoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/835,876

(22) Filed: Jun. 8, 2022

(65) Prior Publication Data

US 2022/0415599 A1 Dec. 29, 2022

(30) Foreign Application Priority Data

Jun. 28, 2021 (JP) ..... 2021-106421

(51) Int. Cl.

| | |
|---|---|
| ***H01H 50/54*** | (2006.01) |
| ***H01H 50/60*** | (2006.01) |
| ***H01H 50/58*** | (2006.01) |
| ***H01H 50/16*** | (2006.01) |
| ***H01H 50/14*** | (2006.01) |

(52) U.S. Cl.

CPC ..... *H01H 50/60* (2013.01); *H01H 50/14* (2013.01); *H01H 50/163* (2013.01); *H01H 50/58* (2013.01); *H01H 2205/002* (2013.01)

(58) Field of Classification Search

CPC ..... H01H 50/60; H01H 50/14; H01H 50/163; H01H 50/58; H01H 2205/002; H01H 9/302; H01H 9/34; H01H 50/023; H01H 50/54

USPC ..... 335/2

See application file for complete search history.

(56) References Cited

U.S. PATENT DOCUMENTS

| | | | | |
|---|---|---|---|---|
| 4,421,959 A * | 12/1983 | Chen | H01H 9/38 | 200/243 |
| 5,546,061 A * | 8/1996 | Okabayashi | H01H 9/443 | 335/126 |
| 6,700,466 B1 * | 3/2004 | Yamamoto | H01H 9/302 | 335/201 |
| 6,975,194 B2 * | 12/2005 | Nishida | H01H 51/2209 | 335/201 |

(Continued)

FOREIGN PATENT DOCUMENTS

JP 2016-24864 A 2/2016

*Primary Examiner* — Shawki S Ismail
*Assistant Examiner* — Lisa N Homza
(74) *Attorney, Agent, or Firm* — SHINJYU GLOBAL IP

(57) ABSTRACT

An electromagnetic relay includes a case, a first fixed terminal including a first fixed contact, a second fixed terminal including a second fixed contact, a movable contact piece including first and second movable contacts, a first magnet, a gas flow path, and a partition member. The case includes an accommodation space and a side wall covering the accommodation space in a first direction. The accommodation space includes a first space where the first fixed contact is disposed and a second space where the second fixed contact is disposed. The first magnet configured to extend a first arc generated between the first fixed contact and the first movable contact in the first direction. The gas flow path is disposed between the side wall and the movable contact piece. The gas flow path includes an inlet communicating with the first space and an outlet communicating with the second space.

10 Claims, 6 Drawing Sheets

(56) References Cited

U.S. PATENT DOCUMENTS

| | | | | |
|---|---|---|---|---|
| 8,519,811 | B2 * | 8/2013 | Sugisawa | H01H 1/54 335/201 |
| 2010/0060394 | A1 * | 3/2010 | Nagura | H01H 9/443 335/189 |
| 2012/0313737 | A1 * | 12/2012 | Iwamoto | H01H 50/56 335/185 |
| 2018/0182584 | A1 * | 6/2018 | Iwamoto | H01H 50/18 |
| 2019/0035585 | A1 * | 1/2019 | Minowa | H01H 50/546 |

* cited by examiner

ELECTROMAGNETIC RELAY

This application claims priority to Japanese Patent Application No. 2021-106421, filed Jun. 28, 2021. The contents of that application are incorporated by reference herein in their entirety.

FIELD

The present invention relates to an electromagnetic relay.

BACKGROUND

In an electromagnetic relay, an arc occurs at the contacts when the current is cut off. As the arc elevates the temperature of the contacts, the contacts may melt and generate a hot gas containing metal vapor. If the hot gas stays in the vicinity of the contacts, the insulation performance between the contacts is degraded, and the arc may reignite. In order to prevent the re-ignition of the arc, the electromagnetic relay disclosed in Japanese Unexamined Patent Application Publication No. 2016-24864 includes an arc-extinguishing space, a gas inflow space separate from the arc-extinguishing space, and a gas passage, all disposed in a case, for allowing the hot gas to escape from the arc-extinguishing space into the gas inflow space.

SUMMARY

In the electromagnetic relay of Japanese Unexamined Patent Application Publication No. 2016-24864, the inlet and outlet of the gas passage are disposed in the vicinity of the contact. Thus, the hot gas easily returns to the contact through the gas passage. As the load capacity increases, the amount of hot gas returning to the vicinity of the contact also increases, which may cause the arc to reignite.

An object of the present invention is to reduce the possibility of re-ignition of an arc at a contact in an electromagnetic relay.

The electromagnetic relay according to one aspect of the present invention includes a case, a first fixed terminal, a second fixed terminal, a movable contact piece, a first magnet, a gas flow path, and a partition member. The case includes an accommodation space and a side wall covering the accommodation space in a first direction. The accommodation space includes a first space and a second space. The first fixed terminal includes a first fixed contact disposed in the first space and a first external connecting portion. The second fixed terminal is disposed apart from the first fixed terminal. The second fixed terminal includes a second fixed contact disposed in the second space and a second external connecting portion protruding from the side wall in the first direction. The movable contact piece extends between the first space and the second space. The movable contact piece includes a first movable contact facing the first fixed contact and a second movable contact facing the second fixed contact. The first magnet configured to extend a first arc generated between the first fixed contact and the first movable contact in the first direction. The gas flow path is disposed between the side wall and the movable contact piece. The gas flow path includes an inlet communicating with the first space and an outlet communicating with the second space. The partition member is disposed between the movable contact piece and the gas flow path, and is configured to partition the first space and the second space from the gas flow path.

In the electromagnetic relay, the gas flow path between the side wall and the movable contact piece allows the hot gas due to the first arc to escape from the first space to the second space, decreasing the hot gas due to the first arc that stays in the first space. Further, the outlet of the gas flow path communicates with the second space, and thereby the outlet is disposed at a position apart from the first fixed contact. Thus, the hot gas, which has flowed from the first space to the second space through the gas flow path, is unlikely to return to the first space. As a result, the possibility of re-ignition of the first arc can be reduced.

The electromagnetic relay may further include a second magnet configured to extend a second arc generated between the second fixed contact and the second movable contact in a second direction opposite to the first direction. In this case, since the second arc is extended in the direction away from the outlet, the possibility of re-ignition of the second arc is reduced.

The electromagnetic relay may further include a drive device disposed in the second direction with respect to the first space and the second space. The drive device may be configured to move the movable contact piece in moving directions including a direction in which the first movable contact approaches the first fixed contact and a direction in which the first movable contact separates from the first fixed contact. In this case, in the electromagnetic relay in which the drive unit is disposed in the second direction from the first space and the second space, the possibility of re-ignition of the first arc is reduced.

The second space may be in communication with a space where the drive unit is installed. In this case, the hot gas due to the second arc can escape to the space where the drive is disposed.

The first magnet may be further configured to extend the first arc in a direction approaching the first magnet as the first arc is extended in the first direction. The case may be disposed between the first magnet and the movable contact piece and may further include an arc contact surface where the first arc contacts. The inlet of the gas flow path may face the arc contact surface. In this case, the hot gas due to the first arc can be efficiently guided to the gas flow path.

The inlet of the gas flow path may include a tapered portion that expands toward the arc contact surface. In this case, the hot gas due to the first arc can be more efficiently guided to the gas flow path.

The partition member may include a tapered surface inclined toward the arc contact surface in a direction approaching the side wall. In this case, the hot gas due to the first arc can be more efficiently guided to the gas flow path.

The partition member may further include a convex portion protruding toward the movable contact piece in a second direction opposite to the first direction. The convex portion may be disposed farther apart from the arc contact surface than the tapered surface. In this case, the convex portion can limit the hot gas, which has flowed from the first space to the second space through the gas flow path, from returning to the vicinity of the first movable contact.

The partition member may be a separate body from the side wall of the case. In this case, the partition member can be made of a material having excellent arc extinguishing performance.

The electromagnetic relay may further include a flow path member. The flow path member may be a separate body from the side wall of the case. The flow path member may be disposed between the side wall and the partition member and may constitute the gas flow path. In this case, the flow path member can be made of a material having excellent arc extinguishing performance.

DETAILED DESCRIPTION

Figure 1:
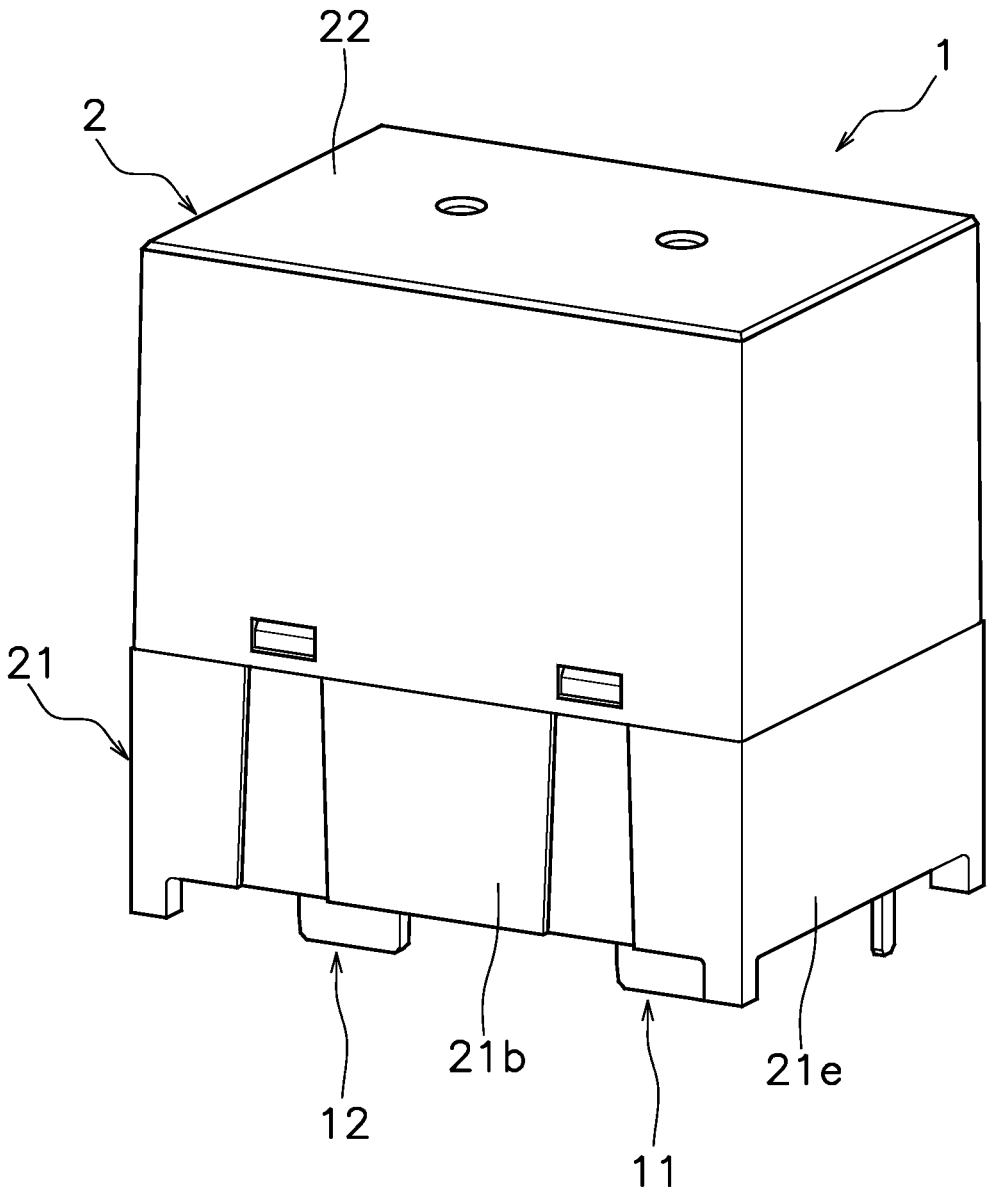
FIG. 1 is a perspective view of an electromagnetic relay.
Figure 2:
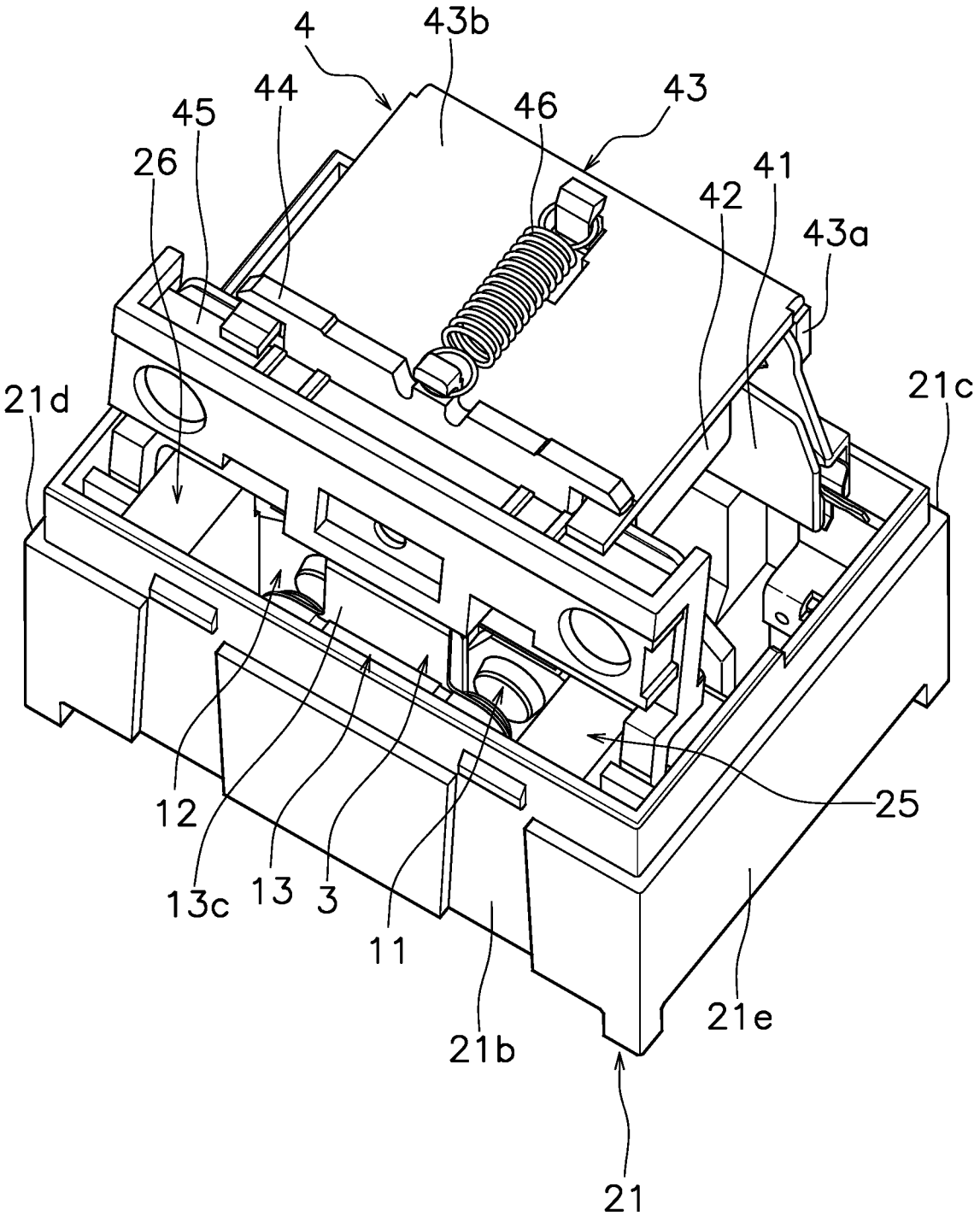
FIG. 2 is a perspective view of an electromagnetic relay with the cover removed.

Hereinafter, an electromagnetic relay 1 according to an embodiment will be described with reference to the drawings. As shown in FIGS. 1 and 2, the electromagnetic relay 1 includes a case 2, a contact device 3, and a drive device 4.

Figure 3:
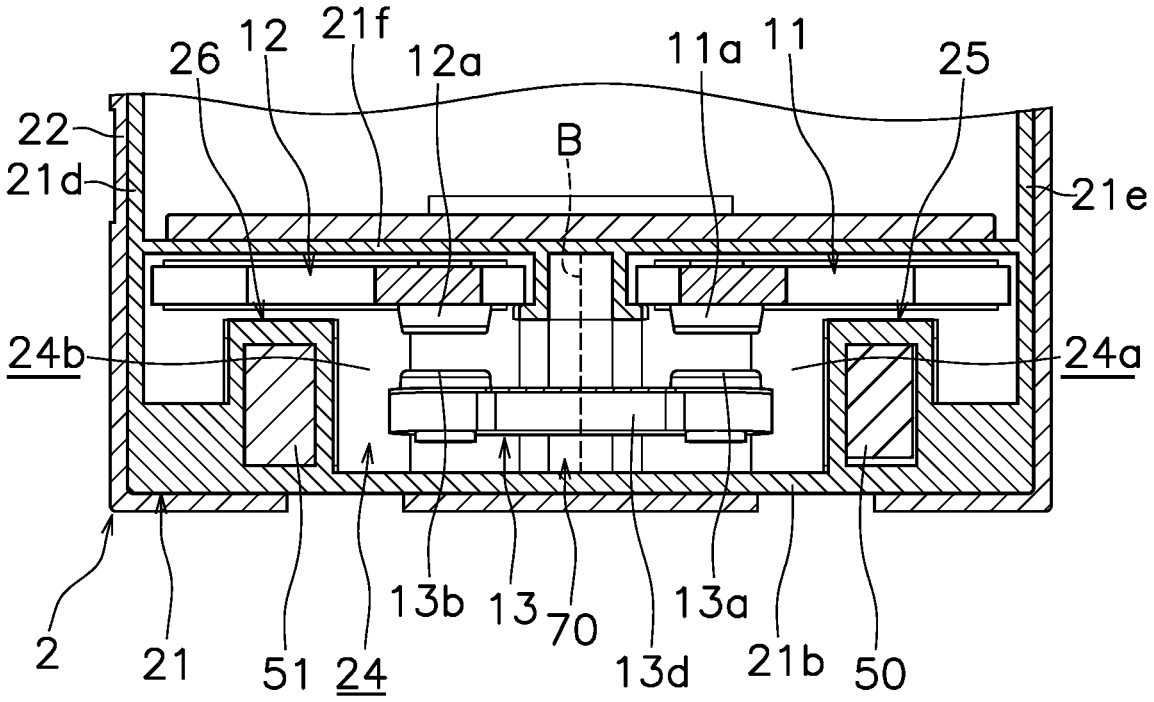
FIG. 3 is a partial cross-sectional view of an electromagnetic relay cut along a plane orthogonal to the up-down direction.

In the following description, the direction in which the contact device 3 and the drive device 4 are disposed with respect to a later-described base 21 of the case 2 is referred to as up (an example of a second direction), and the opposite direction is referred to as down (an example of a first direction). The direction in which the contact device 3 is disposed with respect to the drive device 4 is referred to as front, and the opposite is referred to as back. The left-right direction of the paper of FIG. 3 is referred to as left-right. However, these directions are defined only for convenience of description, and do not limit the arrangement directions of the electromagnetic relay 1.

The case 2 has a box shape. The case 2 made of an insulating material such as resin. The case 2 includes a base 21 and a cover 22. The base 21 supports the contact device 3 and the drive device 4. The base 21 includes a bottom 21*a*, outer walls 21*b* to 21*e*, and an inner wall 21*f*. The bottom 21*a* extends in a direction orthogonal to the up-down direction. The outer wall 21*b* extends upward from the front edge of the bottom 21*a*. The outer wall 21*c* extends upward from the back edge of the bottom 21*a*. The outer wall 21*d* extends upward from the left edge of the bottom 21*a*. The outer wall 21*e* extends upward from the right edge of the bottom 21*a*. The inner wall 21*f* extends upward from the bottom 21*a*. The inner wall 21*f* extends in the left-right direction between the outer wall 21*d* and the outer wall 21*e*. The inner wall 21*f* is disposed between the contact device 3 and the drive device 4 in the front-back direction.

The cover 22 is open downward and is attached to the outer walls 21*b* to 21*e* of the base 21 so as to cover the bottom 21*a* of the base 21 from above. The contact device 3 and the drive device 4 are accommodated in the case 2.

As shown in FIG. 3, the contact device 3 includes a first fixed terminal 11, a second fixed terminal 12, and a movable contact piece 13. In the following description, the first fixed terminal 11 and the second fixed terminal 12 may be referred to as fixed terminals 11 and 12.

The fixed terminals 11 and 12 are made of a conductive material such as copper. The fixed terminals 11 and 12 are plate-shaped terminals and extend in a direction orthogonal to the front-back direction. The fixed terminals 11 and 12 are supported by the bottom 21*a* of the base 21. In the present embodiment, the fixed terminals 11 and 12 are fixedly press-fitted to the bottom 21*a* of the base 21.

Figure 4:
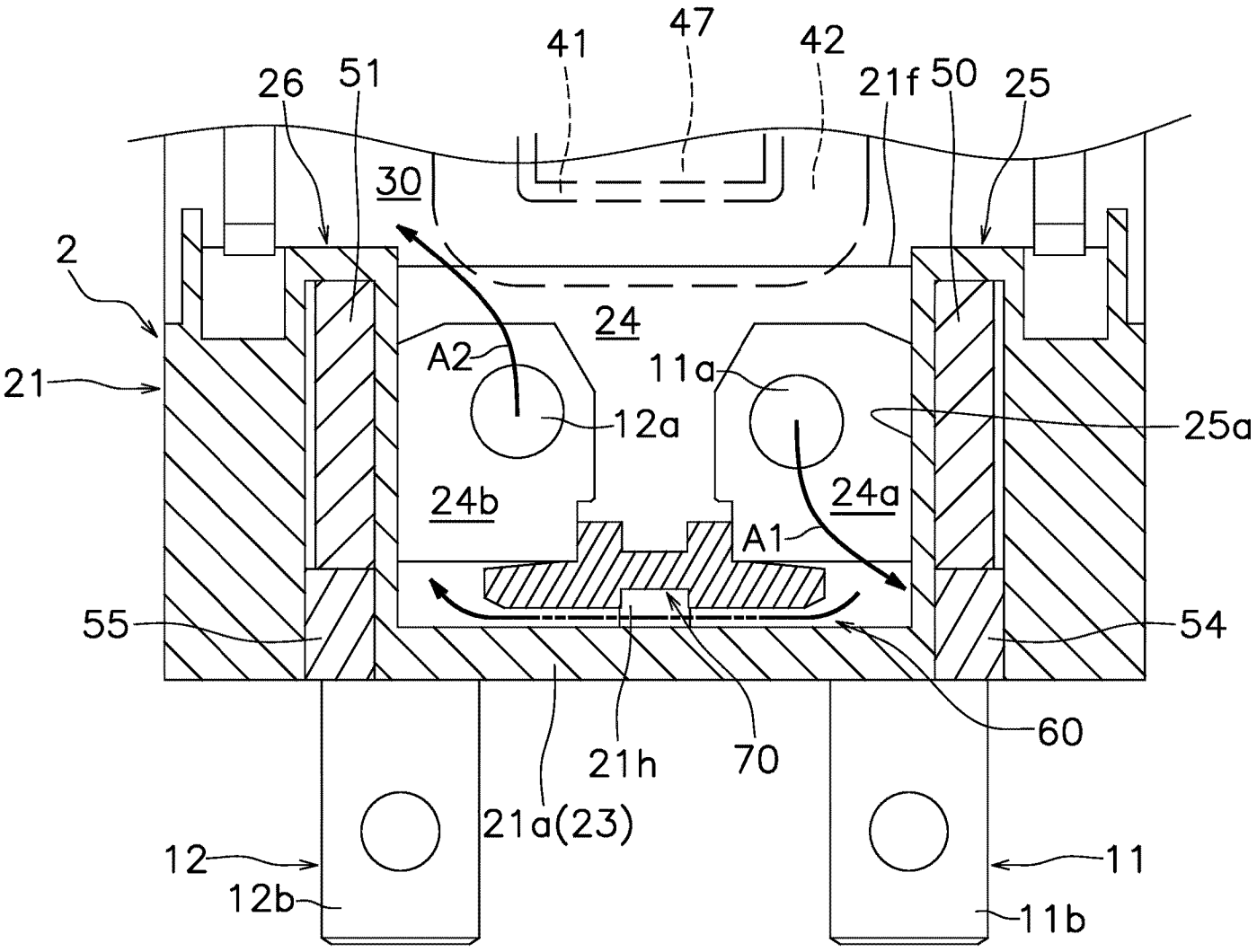
FIG. 4 is a partial cross-sectional view of an electromagnetic relay cut along a plane orthogonal to the front-back direction.
Figure 5:
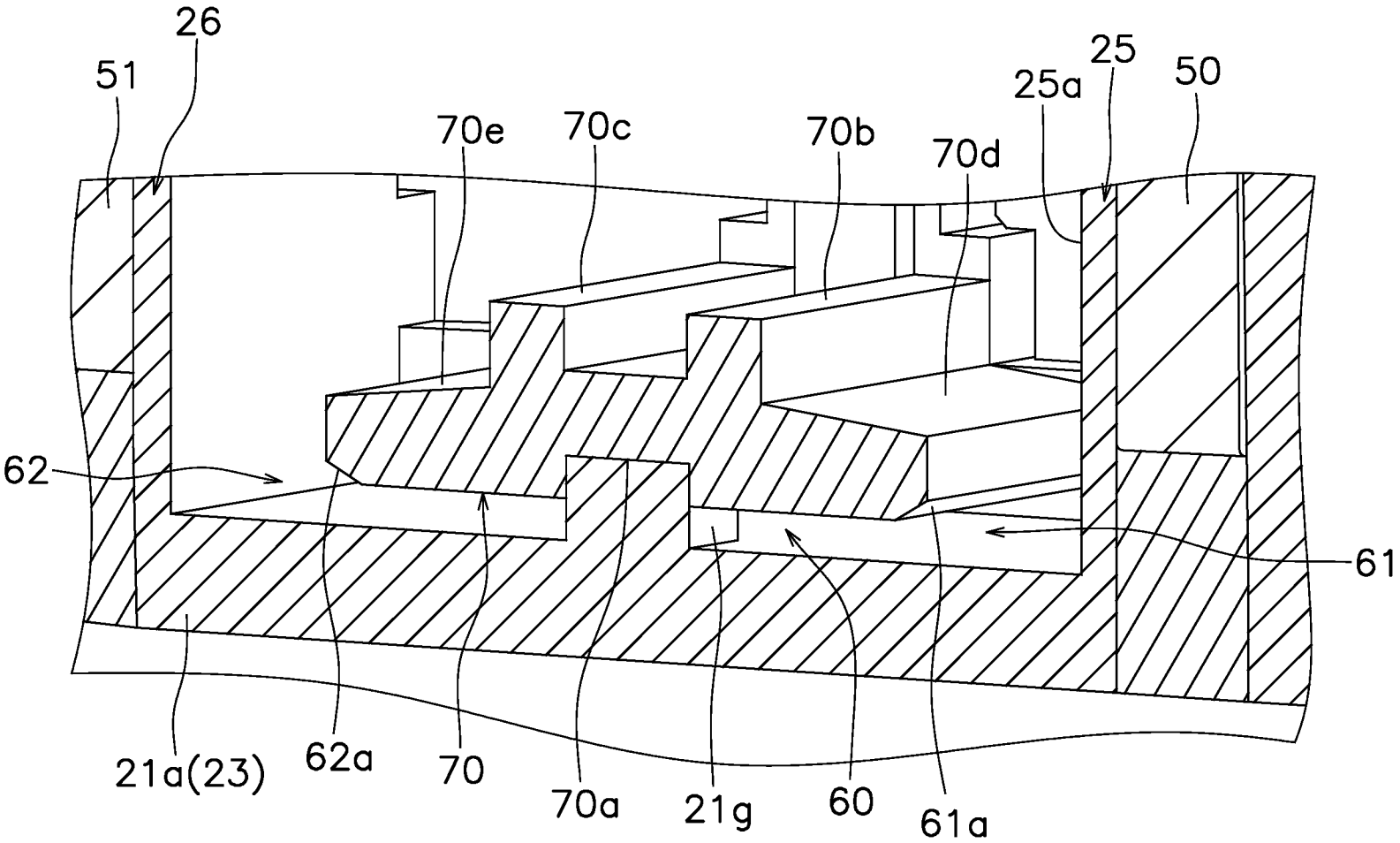
FIG. 5 is a cross-sectional perspective view of the periphery of the partition member.

As shown in FIGS. 3 and 4, the first fixed terminal 11 includes a first fixed contact 11*a* and a first external connecting portion 11*b*. The first fixed contact 11*a* is disposed on the front surface of the first fixed terminal 11. The first fixed contact 11*a* is fixedly caulked to the first fixed terminal 11. Note that the first fixed contact 11*a* may be integrated with the first fixed terminal 11. The first external connecting portion 11*b* protrudes downward from the bottom 21*a* of the base 21 and is electrically connected to an external device (not shown).

The second fixed terminal 12 is apart from the first fixed terminal 11 to the left. The second fixed terminal 12 has a symmetrical shape with respect to the first fixed terminal 11. The second fixed terminal 12 includes a second fixed contact 12*a* and a second external connecting portion 12*b*. The second fixed contact 12*a* is disposed on the front surface of the second fixed terminal 12. The second fixed contact 12*a* is fixedly caulked to the second fixed terminal 12. Note that the second fixed contact 12*a* may be integrated with the second fixed terminal 12. The second external connecting portion 12*b* protrudes downward from the bottom 21*a* of the base 21 and is electrically connected to an external device (not shown).

The movable contact piece 13 is a plate-shaped terminal and is made of a conductive material such as copper. The movable contact piece 13 is disposed in front of the fixed terminals 11 and 12. The movable contact piece 13 has a substantially T-shape when viewed from the front-back direction. The movable contact piece 13 includes a first movable contact 13*a*, a second movable contact 13*b*, an up-down extending portion 13*c*, and a left-right extending portion 13*d*.

The first movable contact 13*a* and the second movable contact 13*b* are fixedly caulked to the movable contact piece 13. The first movable contact 13*a* and the second movable contact 13*b* are disposed on the back surface of the left-right extending portion 13*d*. The first movable contact 13*a* faces the first fixed contact 11*a* in the front-back direction. The first movable contact 13*a* is able to be in contact with the first fixed contact 11*a*. The second movable contact 13*b* is disposed apart from the first movable contact 13*a* to the left. The second movable contact 13*b* faces the second fixed contact 12*a* in the front-back direction. The second movable contact 13*b* is able to be in contact with the second fixed contact 12*a*. The first movable contact 13*a* and the second movable contact 13*b* may be integrated with the movable contact piece 13.

The up-down extending portion 13*c* extends in the up-down direction and is connected to the drive device 4. The left-right extending portion 13*d* extends from the lower part of the up-down extending portion 13*c* in the left-right direction.

The drive device 4 is disposed above the contact device 3. The drive device 4 is disposed above a later-described first space 24*a* and a later-described second space 24*b*. The drive device 4 moves the movable contact piece 13 in the direction in which the first movable contact 13*a* approaches the first fixed contact 11*a* and in the direction in which the first movable contact 13*a* separates from the first fixed contact 11*a*. Further, the drive device 4 moves the movable contact piece 13 in the direction in which the second movable contact 13*b* approaches the second fixed contact 12*a* and in the direction in which the second movable contact 13*b* separates from the second fixed contact 12*a*. In the present embodiment, the drive device 4 moves the movable contact piece 13 in the front-back direction.

As shown in FIGS. 2 and 4, the drive device 4 includes a spool 41, a coil 42, a yoke 43, a movable iron piece 44, a resin member 45, a return spring 46, and a fixed iron core 47.

The spool 41 is tubular and extends in the front-back direction. The coil 42 is wound around the outer circumference of the spool 41. The coil 42 is disposed above the fixed terminals 11, 12. The yoke 43 has an L-shaped bent shape. The yoke 43 includes a coupling portion 43*a* and an extending portion 43*b*. The coupling portion 43*a* is disposed behind the spool 41 and is coupled to the fixed iron core 47. The extending portion 43*b* extends forward from the upper end of the coupling portion 43*a* so as to cover the upper part of the coil 42.

The movable iron piece 44 is disposed in front of the fixed iron core 47. The movable iron piece 44 is rotatably supported by the yoke 43 at the front end of the extending portion 43*b*. The resin member 45 insulates the movable iron piece 44 and the movable contact piece 13. The resin member 45 couples the movable iron piece 44 and the movable contact piece 13. Specifically, the movable iron piece 44 and the movable contact piece 13 are made by insert-molding into the resin member 45. Thus, the resin member 45 and the movable contact piece 13 are rotatable integrally with the movable iron piece 44 in response to the rotation of the movable iron piece 44.

The return spring 46 is a coil spring and extends in the front-back direction. The return spring 46 has a front end connected to the movable iron piece 44 and a back end connected to a yoke 43. The return spring 46 forces the movable contact piece 13 forward via the movable iron piece 44 and the resin member 45. That is, the return spring 46 forces the movable contact piece 13 in the direction in which the first movable contact 13*a* separates from the first fixed contact 11*a* and in the direction in which the second movable contact 13*b* separates from the second fixed contact 12*a*. The fixed iron core 47 is disposed in the spool 41 and penetrates the spool 41 in the front-back direction. The fixed iron core 47 is disposed above the fixed terminals 11, 12.

Next, the operation of the electromagnetic relay 1 will be described. While no voltage is applied to the coil 42, as shown in FIG. 3, by the elastic force of the return spring 46, the first movable contact 13*a* is separated from the first fixed contact 11*a* and the second movable contact 13*b* is separated from the second fixed contact 12*a*. When a voltage is applied to the coil 42 and the coil 42 is excited, the electromagnetic force causes the movable iron piece 44 to be attracted to the fixed iron core 47, which rotates the movable iron piece 44 against the elastic force of the return spring 46. Consequently, the movable contact piece 13 moves backward, the first movable contact 13*a* contacts the first fixed contact 11*a*, and the second movable contact 13*b* contacts the second fixed contact 12*a*. When the application of the voltage to the coil 42 is stopped, the movable iron piece 44 is rotated by the elastic force of the return spring 46. As a result, the movable contact piece 13 moves forward, the first movable contact 13*a* separates from the first fixed contact 11*a*, and the second movable contact 13*b* separates from the second fixed contact 12*a*.

Here, the case 2 further includes a side wall 23, an accommodation space 24, and magnet housings 25, 26. The side wall 23 is configured by the bottom 21*a* of the base 21 in the present embodiment. The side wall 23 covers the accommodation space 24 from below.

The accommodation space 24 is disposed between the base 21 and the cover 22. The accommodation space 24 is between the magnet housing 25 and the magnet housing 26 in the left-right direction. The accommodation space 24 is between the outer wall 21*b* and the inner wall 21*f* in the front-back direction. The first fixed contact 11*a*, the second fixed contact 12*a*, and the movable contact piece 13 are accommodated in the accommodation space 24.

The accommodation space 24 includes a first space 24*a* and a second space 24*b*. The first space 24*a* is a space where the first fixed contact 11*a* and the first movable contact 13*a* are disposed. The second space 24*b* is a space where the second fixed contact 12*a* and the second movable contact 13*b* are disposed. The second space 24*b* is in communication with the first space 24*a*. The boundary B between the first space 24*a* and the second space 24*b* is, for example, the center of the movable contact piece 13 in the left-right direction. The first space 24*a* and the second space 24*b* are, at the upper part, in communication with a space 30 where the drive device 4 is disposed. The drive device 4 is disposed above the first space 24*a* and the second space 24*b* in the case 2. The movable contact piece 13 extends between the first space 24*a* and the second space 24*b*.

The magnet housing 25 is integrally formed with the base 21. The magnet housing 25 is a concave portion that opens downward, and is formed so as to protrude upward from the side wall 23. The magnet housing 25 is disposed to the right of the first fixed contact 11*a* and the first movable contact 13*a*. The magnet housing 25 includes an arc contact surface 25*a*. The arc contact surface 25*a* is disposed between a later-described magnet 50 and the movable contact piece 13 in the left-right direction. The arc contact surface 25*a* extends in a direction orthogonal to the left-right direction. The arc contact surface 25*a* contacts with an arc A1 (an example of the first arc) generated between the first fixed contact 11*a* and the first movable contact 13*a*.

The magnet housing 26 has a symmetrical shape with the magnet housing 25, and is disposed to the left of the second fixed contact 12*a* and the second movable contact 13*b*.

The electromagnetic relay 1 includes magnets 50 and 51, a gas flow path 60, and a partition member 70. The magnet 50 is an example of the first magnet. The magnet 51 is an example of a second magnet. The magnets 50 and 51 are, for example, rectangular permanent magnets. The magnet 50 is disposed to the right of the first fixed contact 11*a* and the first movable contact 13*a*. The magnet 50 is housed in the magnet housing 25. The magnet 50 is inserted into the magnet housing 25 from below, and a support member 54 configure to support the magnet 50 from below retains the magnet 50 within the magnet housing 25.

The magnet 50 is disposed so that the magnetic flux in the vicinity of the first fixed contact 11*a* flows to the right. As shown in FIG. 4, the magnet 50 extends the arc A1 downward. Specifically, for example, when a current flows from the first movable contact 13*a* toward the first fixed contact 11*a*, a downward Lorentz force acts on the arc A1, and the arc A1 is extended downward. As shown in FIG. 4, as extended downward, the arc A1 is extended in a direction to approach the arc contact surface 25*a*.

The magnet 51 is disposed to the left of the second fixed contact 12*a* and the second movable contact 13*b*. The magnet 51 is housed in the magnet housing 26. The magnet 51 is inserted into the magnet housing 26 from below, and a support member 55 configure to support the magnet 51 from below retains the magnet 51 within the magnet housing 26.

The magnet 51 is disposed so that the magnetic flux in the vicinity of the second fixed contact 12*a* flows to the right. The magnet 51 is disposed to face the magnet 50 at the different poles each other. The magnet 51 extends upward an arc A2 (an example of the second arc) generated between the second fixed contact 12*a* and the second movable contact 13*b*. Specifically, for example, when a current flows from the second fixed contact 12*a* toward the second movable contact 13*b*, an upward Lorentz force acts on the arc A2, and the arc A2 is extended upward. As shown in FIG. 4, as extended upward, the arc A2 is extended to approach the magnet 51.

The gas flow path 60 is disposed in the accommodation space 24. The gas flow path 60 is a path for releasing the hot gas due to the first arc from the first space 24*a* to the second space 24*b*. The gas flow path 60 is disposed below the first space 24*a* to the second space 24*b*. The gas flow path 60 is disposed between the side wall 23 and the movable contact piece 13 in the up-down direction. The gas flow path 60 is disposed between the magnet housing 25 and the magnet housing 26 in the left-right direction. The gas flow path 60 extends in the left-right direction. The gas flow path 60 is configured by the side wall 23, the partition member 70, the outer wall 21*b*, and the inner wall 21*f*.

The gas flow path 60 includes an inlet 61 and an outlet 62. The inlet 61 is in communication with the first space 24*a*. The inlet 61 faces the arc contact surface 25*a*. The inlet 61 includes a tapered portion 61*a* that expands toward the arc contact surface 25*a*. The inlet 61 is closer to the arc contact surface 25*a* than the center of the first fixed contact 11*a* and the center of the first movable contact 13*a* in the left-right direction.

The outlet 62 is in communication with the second space 24*b*. The outlet 62 faces the magnet housing 26. The outlet 62 includes a tapered portion 62*a* that expands toward the magnet housing 26. The outlet 62 is closer to the magnet housing 26 than the center of the second fixed contact 12*a* and the center of the second movable contact 13*b* in the left-right direction.

The partition member 70 is a separate body from the base 21. The partition member 70 is made of, for example, a material having better arc extinguishing performance than that of the base 21. The partition member 70 may be made of the same material as that of the base 21. The partition member 70 is fixed to the base 21.

The partition member 70 is disposed in the accommodation space 24. The partition member 70 is disposed between the movable contact piece 13 and the gas flow path 60. The partition member 70 partitions the first space 24*a* and the second space 24*b* from the gas flow path 60. The partition member 70 extends in the left-right direction and the front-back direction. The partition member 70 has, in the front-back direction, side surfaces that are in contact with the outer wall 21*b* and the inner wall 21*f*. The side surfaces of the partition member 70 in the left-right direction are separated from the magnet housings 25 and 26. The lower surface of the partition member 70 is separated from the side wall 23.

The partition member 70 includes a concave portion 70*a*, convex portions 70*b*, 70*c*, and tapered surfaces 70*d*, 70*e*. The concave portion 70*a* is formed on the lower surface of the partition member 70. The concave portion 70*a* is formed at the center of the partition member 70 in the left-right direction. The concave portion 70*a* is open downward.

The partition member 70 is supported by support portions 21*g* and 21*h* that are formed on the base 21. Specifically, the concave portion 70*a* of the partition member 70 is supported by the support portions 21*g* and 21*h*. The support portion 21*g* has a shape protruding from the outer wall 21*b* toward the accommodation space 24. The support portion 21*g* is connected to the side wall 23. The support portion 21*h* has a shape protruding from the inner wall 21*f* toward the accommodation space 24. The support portion 21*h* is connected to the side wall 23. The support portion 21*g* is separated from the support portion 21*g* in the front-back direction.

The convex portions 70*b* and 70*c* are formed on the upper surface of the partition member 70. The convex portions 70*b* and 70*c* protrude upward toward the movable contact piece 13. The convex portions 70*b* and 70*c* are disposed farther from the arc contact surface 25*a* than the tapered surface 70*d* in the left-right direction. The convex portion 70*b* is disposed in the first space 24*a*. The convex portion 70*b* is disposed to the left of the first fixed contact 11*a* and the first movable contact 13*a* in the first space 24*a*. The convex portion 70*c* is disposed in the second space 24*b*. The convex portion 70*c* is disposed to the right of the second fixed contact 12*a* and the second movable contact 13*b* in the second space 24*b*.

The tapered surfaces 70*d* and 70*e* are formed on the upper surface of the partition member 70. The tapered surface 70*d* is disposed below the first fixed contact 11*a* and the first movable contact 13*a*. The tapered surface 70*d* is inclined toward the arc contact surface 25*a* in a direction approaching the side wall 23. The tapered surface 70*e* is disposed below the second fixed contact 12*a* and the second movable contact 13*b*. The tapered surface 70*e* is inclined toward the magnet housing 26 in a direction approaching the side wall 23.

In the electromagnetic relay 1 described above, the gas flow path 60 between the side wall 23 of the case 2 and the movable contact piece 13 allows the hot gas due to the arc A1 to escape from the first space 24*a* to the second space 24*b*. Accordingly, the hot gas due to the arc A1 is hindered from staying in the first space 24*a*. Specifically, as shown by the alternate long and short dash line in FIG. 4, the hot gas due to the arc A1 flows from the first space 24*a* to the second space 24*b* through the gas flow path 60. Further, the outlet 62 of the gas flow path 60 is in communication with the second space 24*b*, and thereby the outlet 62 is disposed at a position apart from the first fixed contact 11*a*. Thus, the hot gas, which has flowed from the first space 24*a* to the second space 24*b* through the gas flow path 60, is unlikely to return to the first space 24*a*. As a result, the possibility of re-ignition of the arc A1 can be reduced.

One embodiment of the present invention has been described above, but the present invention is not limited to the above embodiment, and various modifications can be made without departing from the gist of the invention.

The configurations of the contact device 3 and the drive device 4 may be modified. The drive device 4 may have a plunger type structure. The configuration of the case 2 may be changed. The arrangement and shape of the magnets 50 and 51 may be changed.

The shape of the partition member 70 may be changed. The partition member 70 may have any shape that partitions the first space 24*a* and the second space 24*b* from the gas flow path 60. For example, at least one of the convex portions 70*b* and 70*c* may be omitted, or a convex portion may be formed at the boundary B between the first space 24*a* and the second space 24*b*.

Figure 6:
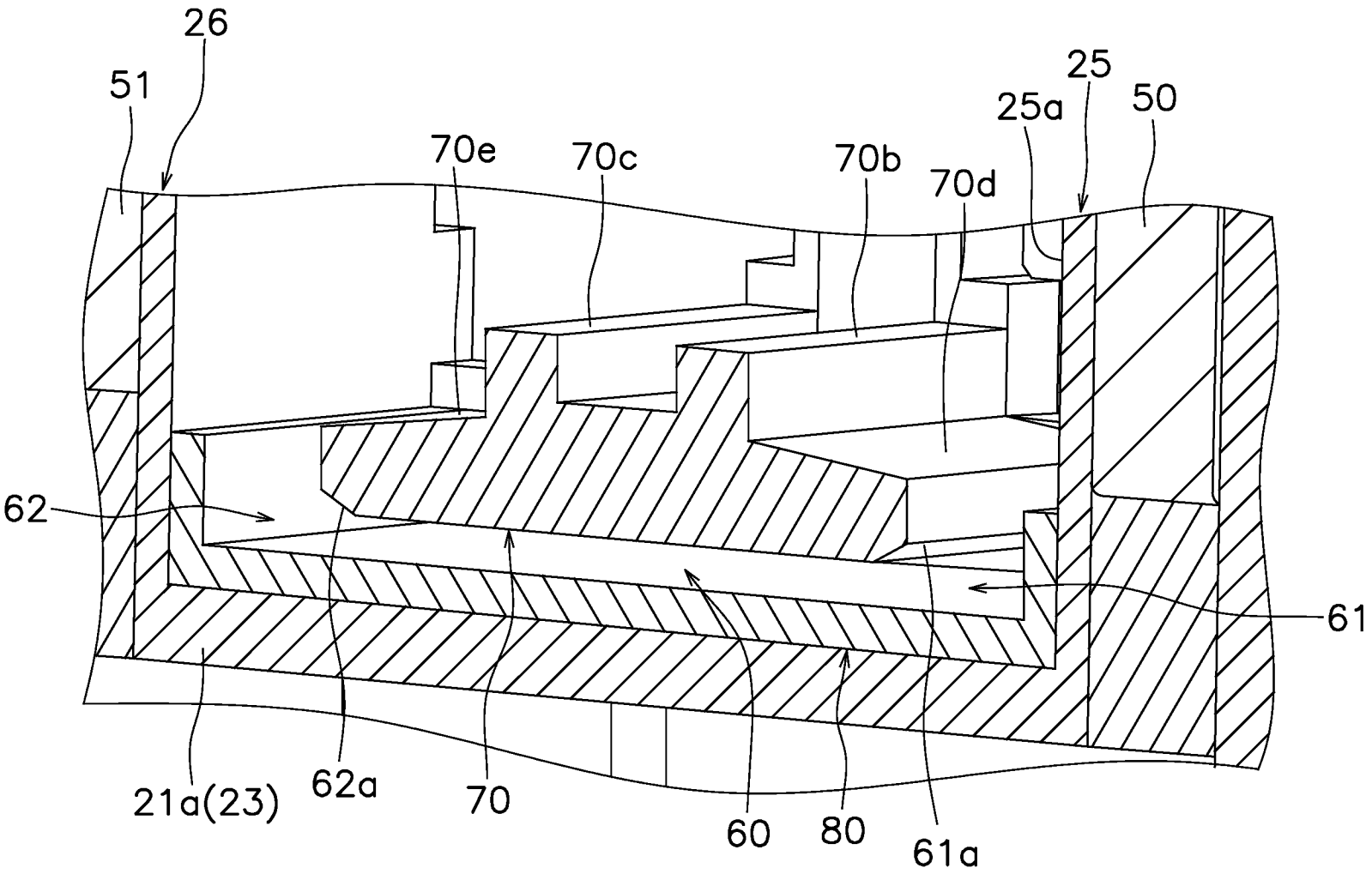
FIG. 6 is a cross-sectional perspective view of the periphery of the partition member according to a modified example.

FIG. 6 is a cross-sectional perspective view of the periphery of the partition member 70 according to a modified example. The electromagnetic relay 1 may further include a flow path member 80. The flow path member 80 is a separate body from the case 2. The flow path member 80 is disposed between the side wall 23 and the partition member 70. Here, the gas flow path 60 is configured by the flow path member 80, the partition member 70, the outer wall 21*b*, and the inner wall 21*f*. The flow path member 80 is fixed to the side wall 23. The flow path member 80 may be made of, for example, a material having better arc extinguishing performance than that of the base 21. The partition member 70 and the flow path member 80 may be integrated together.

REFERENCE NUMERALS

1 Electromagnetic relay
2 Case
4 Drive device
11 First fixed terminal
12 Second fixed terminal
12*a* Second fixed contact
13 Movable contact piece
13*a* First movable contact
13*b* Second movable contact
23 Side wall
24 Accommodation space
24*a* First space
24*b* Second space
25*a* Arc contact surface
50 Magnet (one example of first magnet)
51 Magnet (one example of second magnet)
60 Gas flow path
61*a* Tapered portion
70 Partition member
70*d* Tapered surface

The invention claimed is:

1. An electromagnetic relay comprising:

a case including an accommodation space and a side wall covering the accommodation space in a first direction, the accommodation space including a first space and a second space;

a first fixed terminal including a first fixed contact disposed in the first space and a first external connecting portion protruding from the side wall in the first direction;

a second fixed terminal disposed apart from the first fixed terminal, the second fixed terminal including a second fixed contact disposed in the second space and a second external connecting portion protruding from the side wall in the first direction;

a movable contact piece extending between the first space and the second space, the movable contact piece including a first movable contact facing the first fixed contact and a second movable contact facing the second fixed contact;

a first magnet configured to extend a first arc generated between the first fixed contact and the first movable contact in the first direction;

a gas flow path disposed between the side wall and the movable contact piece, the gas flow path including an inlet communicating with the first space and an outlet communicating with the second space; and a partition member disposed between the movable contact piece and the gas flow path, the partition member configured to partition the first space and the second space from the gas flow path.

2. The electromagnetic relay according to claim 1, further comprising:

a second magnet configured to extend a second arc generated between the second fixed contact and the second movable contact in a second direction opposite to the first direction.

3. The electromagnetic relay according to claim 2, further comprising:

a drive device disposed in the case in the second direction with respect to the first space and the second space, the drive device configured to move the movable contact piece in moving directions including a direction in which the first movable contact approaches the first fixed contact and a direction in which the first movable contact separates from the first fixed contact.

4. The electromagnetic relay according to claim 3, wherein the second space is in communication with a space where the drive device is installed.

5. The electromagnetic relay according to claim 1, wherein the first magnet is further configured to extend the first arc in a direction approaching the first magnet as the first arc is extended in the first direction, the case is disposed between the first magnet and the movable contact piece, the case further having an arc contact surface where the first arc contacts, and the inlet of the gas flow path faces the arc contact surface.

6. The electromagnetic relay according to claim 5, wherein the inlet of the gas flow path includes a tapered portion expanding toward the arc contact surface.

7. The electromagnetic relay according to claim 5, wherein the partition member has a tapered surface inclined toward the arc contact surface in a direction approaching the side wall.

8. The electromagnetic relay according to claim 7, wherein the partition member further includes a convex portion protruding toward the movable contact piece in a second direction opposite to the first direction, the convex portion being disposed farther apart from the arc contact surface than the tapered surface.

9. The electromagnetic relay according to claim 1, wherein the partition member is a separate body from the side wall of the case.

10. The electromagnetic relay according to claim 1, further comprising:

a flow path member which is a separate body from the side wall of the case, the flow path member being disposed between the side wall and the partition member, the flow path member constituting the gas flow path.

* * * * *